US010780365B2

(12) United States Patent
Shapiro et al.

(10) Patent No.: US 10,780,365 B2
(45) Date of Patent: Sep. 22, 2020

(54) BUBBLE GENERATING APPARATUS

(71) Applicant: Honor Metro Limited, Tsim Sha Tsui, Kowloon (HK)

(72) Inventors: Ami Shapiro, Woodland Hills, CA (US); Jeffrey Falerni, Agoura Hills, CA (US)

(73) Assignee: Honor Metro Limited, Tsim Sha Tsui (HK)

( * ) Notice: Subject to any disclaimer, the term of this patent is extended or adjusted under 35 U.S.C. 154(b) by 0 days.

(21) Appl. No.: 16/197,798

(22) Filed: Nov. 21, 2018

(65) Prior Publication Data

US 2020/0155958 A1 May 21, 2020

(51) Int. Cl.
*A63H 33/28* (2006.01)
*A63H 33/00* (2006.01)

(52) U.S. Cl.
CPC ..... *A63H 33/28* (2013.01); *A63H 33/007* (2013.01)

(58) Field of Classification Search
CPC ..... A63H 33/28; A63H 33/007; A63H 7/02
See application file for complete search history.

(56) References Cited

U.S. PATENT DOCUMENTS 1,583,567 A * 5/1926 Becker ..... A63H 33/007 446/237
2,412,732 A * 12/1946 Holman ..... A63H 33/28 40/408
2,547,825 A * 4/1951 King ..... A63H 33/28 446/16
2,736,988 A * 3/1956 Fisher ..... A63H 33/28 446/17
3,711,988 A * 1/1973 Summerfield ..... A63H 5/00 446/412
3,913,260 A * 10/1975 Corbett ..... A63H 33/28 446/16

(Continued)

FOREIGN PATENT DOCUMENTS

CN 201719820 U 1/2011

OTHER PUBLICATIONS

Unisquare, Fisher-Price Bubble Mower Toddler Toy Fun Blower Play Gift Yard Speed Throttle; internet at https://www.unisquare.com/sale/fisher-price-bubble-mower-toddler-toy-fun-blower-play-gift-yard-speed-throttle-565354/ printed Nov. 21, 2018.

(Continued)

*Primary Examiner* — Melba Bumgarner
*Assistant Examiner* — Amir A Klayman
(74) *Attorney, Agent, or Firm* — Belles Katz LLC

(57) ABSTRACT

An apparatus for generating bubbles. The apparatus may include a wheel having an outer surface that lies on a reference cylinder. The wheel may be configured to rotate about a first rotational axis. A fan device that is configured to generate an air stream may be located within the reference cylinder. A bubble generating assembly may also be located within the reference cylinder. The bubble generating assembly may include at least one bubble generating device. In use, rotation of the wheel about the first rotational axis may be configured to load a bubble solution onto the bubble generating device of the bubble generating assembly. In addition, or as an alternative, rotation of the wheel about the first rotational axis may be configured to rotate the fan device about a second rotational axis to generate the air stream.

19 Claims, 10 Drawing Sheets

(56) References Cited

U.S. PATENT DOCUMENTS

| | | | | |
|---|---|---|---|---|
| 4,016,673 | A * | 4/1977 | Constance | A63H 33/28 446/18 |
| 4,044,496 | A * | 8/1977 | Jernstrom | A63H 33/28 446/16 |
| 4,145,065 | A * | 3/1979 | Kupka | B62K 3/002 188/5 |
| 4,604,074 | A * | 8/1986 | Engle | A63H 33/00 446/171 |
| 4,764,141 | A | 8/1988 | D'Andrade | |
| RE32,973 | E | 7/1989 | Panzarella | |
| 5,348,507 | A * | 9/1994 | McGhie | A63H 33/28 446/15 |
| 5,366,402 | A | 11/1994 | Rudell et al. | |
| 5,542,869 | A * | 8/1996 | Petty | A63H 33/28 446/16 |
| 5,603,651 | A * | 2/1997 | Shure | A63H 33/28 446/16 |
| 5,643,035 | A | 7/1997 | Freese et al. | |
| 5,746,636 | A | 5/1998 | Cernansky et al. | |
| 6,024,623 | A | 2/2000 | Menow et al. | |
| 6,345,676 | B1 * | 2/2002 | Huntsberger | A63H 33/28 180/65.1 |
| 6,953,376 | B1 | 10/2005 | Kim et al. | |
| 8,141,889 | B2 | 3/2012 | Yu et al. | |
| 2010/0009591 | A1 | 1/2010 | Trzecieski | |
| 2012/0220184 | A1 * | 8/2012 | Orem | A63H 33/28 446/16 |

OTHER PUBLICATIONS

Sears, Bubble Club Bubble Lawn Mower, internet at https://www.sears.com/lanard-bubble-club-bubble-lawn-mower/p-SPM11037296415#, printed Nov. 21, 2018.

Fisher-Price, Bubble Mower-Pink, internet at https://fisher-price.mattel.com/shop/en-us/fp/walkers-push-toys/bubble-mower-cgm04, printed Nov. 21, 2018.

Toy Bubble, Childs Bubble Blowing Lawn Mower, internet at https://toybubble.com/childs-bubble-blowing-lawn-mower/, printed Nov. 21, 2018.

Bubble Inc., Bubble Lawn Mower, internet at https://www.bubbleinc.co.uk/products/bubble-lawn-mower, printed Nov. 21, 2018.

Amazon, Push 'N' Bubble Lawn Mower Machine with Realistic Sound, internet at https://www.amazon.com/Bubble-Mower-Machine-Realistic-Sound/dp/B071H4Q8Z7, printed Nov. 21, 2018.

* cited by examiner

BUBBLE GENERATING APPARATUS

BACKGROUND OF THE INVENTION

Children love bubbles and the bubble makers that are used to create them. At least as far as children are concerned, there is a general understanding that the more bubbles that are made and the quicker they are made, the better the bubble maker. Simple wands that produce bubbles by loading the wands with a bubble solution and blowing through the wands with air from a person's mouth are well known. Furthermore, certain types of automated bubble producing devices, such as bubble producing guns, are also known. However, these types of devices can make a terrible mess in the hands of a child (the same goes for some adults, too) and are only entertaining to a child for a brief period of time. Thus, a need exists for an apparatus for generating bubbles which is more interactive and overcomes the above-noted deficiencies.

BRIEF SUMMARY OF THE INVENTION

Exemplary embodiments according to the present disclosure are directed to an apparatus for generating bubbles. The apparatus may include a wheel having an outer surface that lies on a reference cylinder. The wheel may be configured to rotate about a first rotational axis. A fan device that is configured to generate an air stream may be located within the reference cylinder. A bubble generating assembly may also be located within the reference cylinder. The bubble generating assembly may include at least one bubble generating device. In use, rotation of the wheel about the first rotational axis may be configured to load a bubble solution onto the bubble generating device of the bubble generating assembly. In addition, or as an alternative, rotation of the wheel about the first rotational axis may be configured to rotate the fan device about a second rotational axis to generate the air stream.

In one aspect, the invention may be an apparatus for generating bubbles comprising: a wheel having an outer surface that lies on a reference cylinder, the wheel configured to rotate about a first rotational axis; a fan device located within the reference cylinder, the fan device configured to generate an air stream; a bubble generating assembly located within the reference cylinder, the bubble generating assembly comprising at least one bubble generating device; and wherein rotation of the wheel about the first rotational axis is configured to at least one of: (1) load a bubble solution onto the bubble generating device of the bubble generating assembly; or (2) rotate the fan device about a second rotational axis to generate the air stream.

In another aspect, the invention may be an apparatus for generating bubbles comprising: a wheel that is rotatable about a first rotational axis; a reservoir for holding a supply of a bubble solution; a fan device operably coupled to the wheel and located within the wheel; a bubble generating assembly operably coupled to the wheel, the bubble generating assembly comprising at least one bubble generating device; and wherein rotation of the wheel about the first rotational axis is configured to: (1) rotate the fan device about a second rotational axis to generate an air stream; and (2) rotate the bubble generating assembly about the first rotational axis to load the bubble solution onto the bubble generating device and then align the bubble generating device that is loaded with the bubble solution with the air stream to generate bubbles.

In yet another aspect, the invention may be a bubble generating toy comprising: a wheel that is configured to rotate about a first rotational axis, the wheel having an inner surface that defines an interior space; a hub assembly coupled to the wheel and comprising a reservoir containing a supply of a bubble solution, the hub assembly comprising an opening that forms a passageway between the ambient environment and the reservoir; a handle assembly coupled to the hub assembly and configured to be gripped by a user so that the user can push the bubble generating toy with the wheel in contact with a ground surface, thereby causing the wheel to rotate about the first rotational axis relative to the hub assembly; a fan device located within the interior space of the wheel, wherein the fan device is operably coupled to the wheel so that rotation of the wheel about the first rotational axis causes the fan device to generate an air stream; and a bubble generating assembly comprising a plurality of bubble generating devices located within the reservoir of the hub assembly, wherein the bubble generating assembly is operably coupled to the wheel so that rotation of the wheel about the first rotational axis causes the plurality of bubble generating devices to repetitively move: (1) into contact with the bubble solution in the cavity to load the bubble generating devices with the bubble solution; and (2) into simultaneous alignment with the air stream generated by the fan device and the opening in the hub assembly to generate bubbles from the bubble solution loaded on the bubble generating devices and allow the bubbles to flow into the ambient environment.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
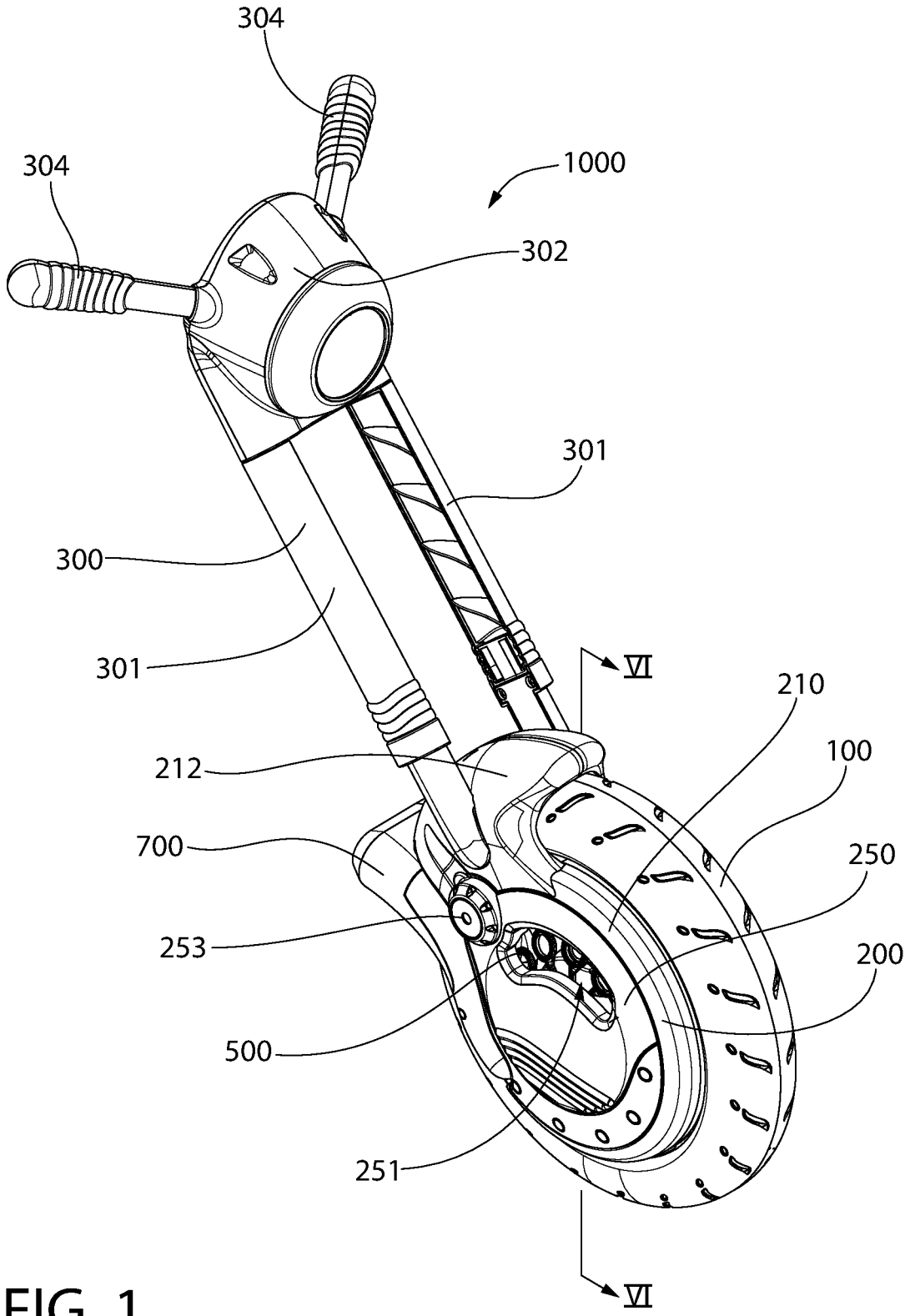
FIG. 1 is a front perspective view of an apparatus for generating bubbles in accordance with an embodiment of the present invention.
Figure 2:
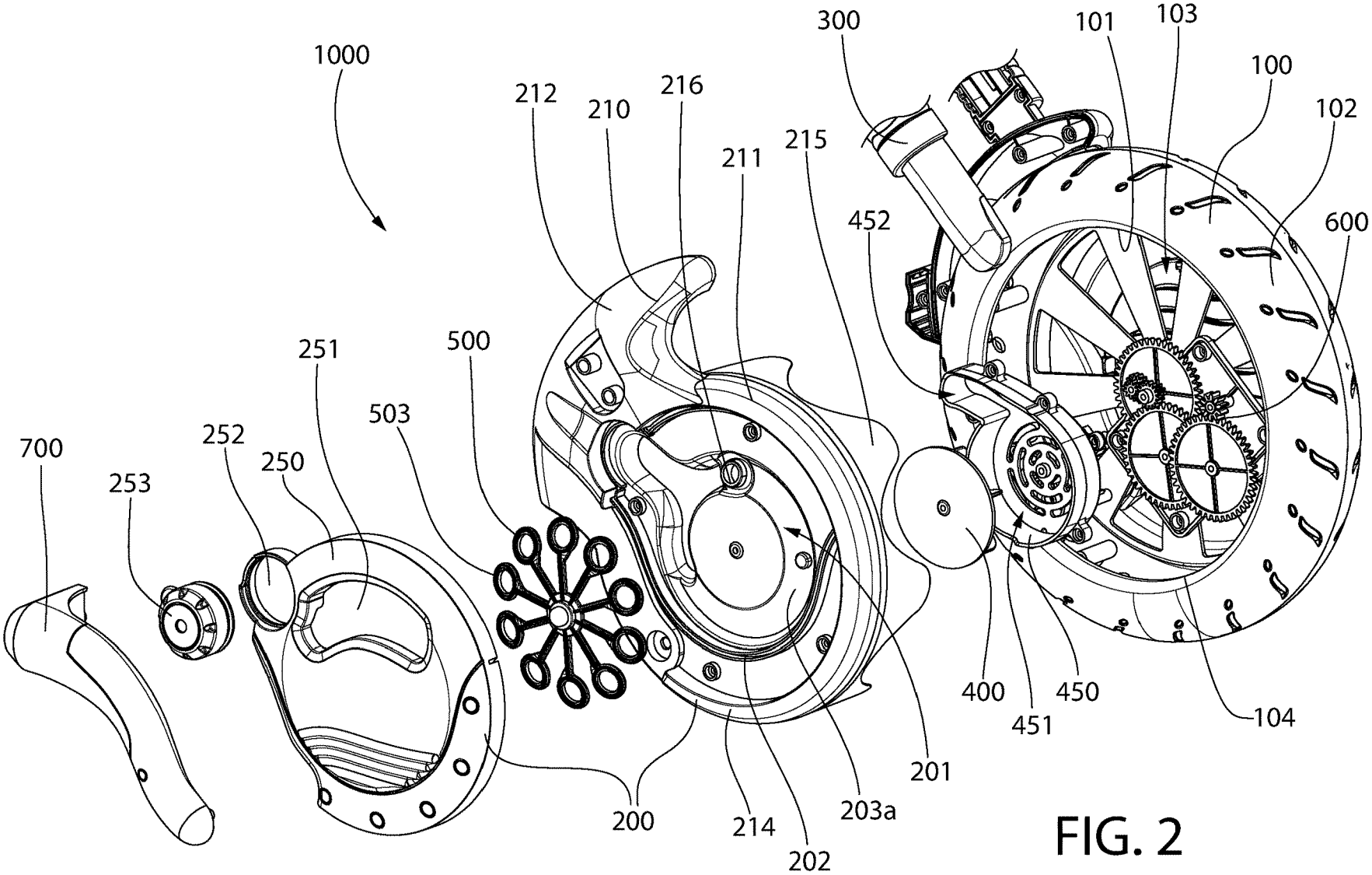
FIG. 2 is an exploded view of the apparatus of FIG. 1.
Figure 3:
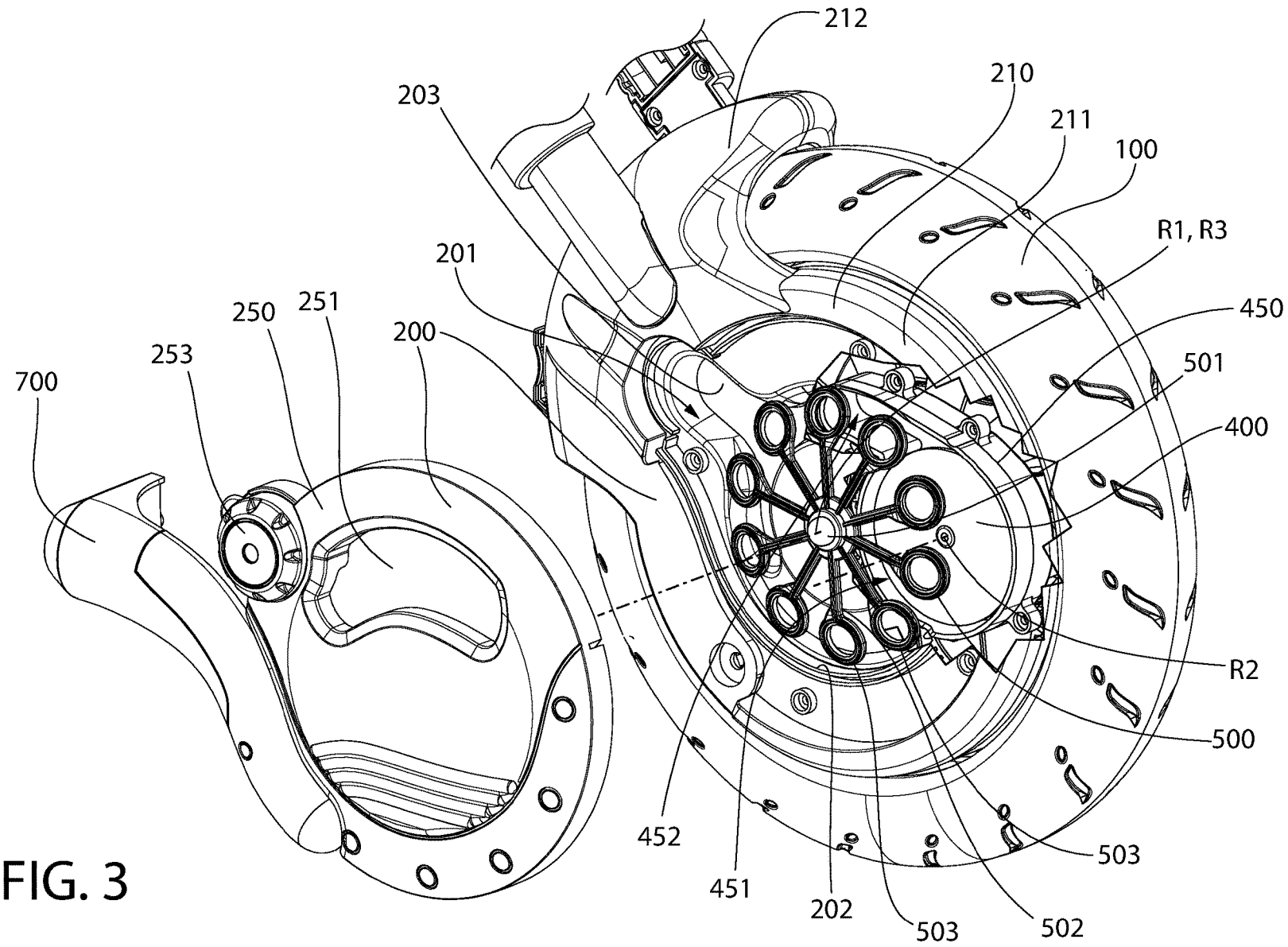
FIG. 3 is a partially exploded view of the apparatus of FIG. 1 with a portion of a reservoir component broken away to expose a fan device.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to FIGS. 1-3 and 6, an apparatus for generating bubbles (hereinafter "the apparatus") 1000 will be described. The apparatus 1000 may be a toy that can be used by a child to generate bubbles from a bubble solution. In the exemplified embodiment, the apparatus 1000 is intended to be pushed along a ground surface by a user, with such action causing the apparatus 1000 to automatically generate bubbles (assuming that there is bubble solution located in the reservoir as described herein). In the exemplified embodiment, the apparatus 1000 does not include any electronic components that would require a power source. Specifically, the apparatus 1000 may not include any batteries or other components that can be used as a power source, and thus the bubble generation is achieved in an entirely mechanical way. The apparatus 1000 may be devoid of batteries, electric pumps, electronic circuits, motors, or the like. Of course, in some alternative embodiments which may be mentioned briefly below, the apparatus 1000 could include batteries, pumps, motors, etc. However, in the preferred embodiment the apparatus 1000 does not include any such components, which keeps costs down for the manufacturer and the consumer without detracting from the end result and entertainment value of the apparatus 1000.

The apparatus 1000 generally comprises a wheel 100, a hub assembly 200, and a handle assembly 300 that are operably coupled together and interact with one another in a desired manner that will be described in greater detail below. The apparatus 1000 also includes an air stream generator or fan device 400, a bubble generating assembly 500, and a gear assembly 600. The apparatus 1000 may also include a kickstand 700 for supporting the apparatus 1000 in an upright position when it is not in use, as described in more detail with reference to FIGS. 5A and 5B. In the exemplified embodiment, the apparatus 1000 has a single wheel 100 and may be used as a support for a child who is learning to walk while also providing entertainment to the child by generating bubbles as the child walks with the apparatus 1000. Thus, the apparatus 1000 may serve as an encouragement to a child to learn how to walk so that the child can be rewarded with bubble generation. In the exemplified embodiment, normal use of the apparatus 1000 causes the wheel 100 to rotate, which automatically causes bubbles to be generated so long as bubble solution is present in a reservoir. In some embodiments, the apparatus 1000 may include multiple wheels (two wheels, three wheels, four wheels, etc.). In some embodiments bubbles may be generated within each of the wheels, and in other embodiments bubbles may be generated in only one or some but less than all of the wheels.

The wheel 100 comprises an inner surface 101 and an outer surface 102. The inner surface 101 defines or bounds an interior space 103 within which certain other components of the apparatus 100 are located. The wheel 100 has a first opening 104 that provides a passageway into the interior space 103, best seen in FIG. 2. The outer surface 102 of the wheel 100, or a portion thereof, lies on a reference cylinder RC, depicted in FIG. 6. The reference cylinder RC is a cylinder that contacts the outer surface 102 of the wheel 100 without extending through any part of the wheel 100 and without intersecting the interior space 103. Thus, the reference cylinder RC may be tangent to the outer surface 102 of the wheel 100. Stated another way, an outermost portion of the outer surface 102 of the wheel 100 lies on the reference cylinder RC. The reference cylinder RC only touches the outer surface 102 of the wheel 100 but does not penetrate the wheel 100 at any location. The wheel 100 is configured to rotate about a first rotational axis R1. In the exemplified embodiment, the first rotational axis R1 forms a longitudinal axis of the reference cylinder RC and is centrally located within the reference cylinder RC. Thus, the first rotational axis R1 and the reference cylinder RC are parallel to one another. In the exemplified embodiment, an annular portion of the outer surface 102 of the wheel 100 that is located furthest from the first rotational axis R1 of the wheel 100 lies on the reference cylinder RC. This annular portion of the outer surface 102 of the wheel 100 is the portion that contacts a ground surface when the apparatus 1000 is in use as described below.

The gear assembly 600 is located within the reference cylinder RC, and in the exemplified embodiment the gear assembly 600 is located within interior space 103 of the wheel 100. As used herein, the interior space 103 of the wheel 100 is defined as the empty space that is located within the bounds of the wheel 100 if the openings into the empty space (such as the first opening 104) were to be closed. Thus, to be located within the interior space 103 of the wheel 100, a component must not extend beyond the boundary of the wheel 100 in any direction. Of course, it is possible for some components to be partially located within the interior space 103 so that a portion of said component is located within the interior space 103 and another portion of said component extends to the outside of the interior space 103. In the exemplified embodiment, the gear assembly 600 is located entirely within the interior space 103 of the wheel 100.

The gear assembly 600 comprises a plurality of gears that are operably coupled to the wheel 100, the fan device 400, and the bubble generating assembly 500 so that upon rotation of the wheel 100, the fan device 400 and the bubble generating assembly 500 are also made to rotate. Thus, in an entirely mechanical way and without any power sources, motors, or the like, the fan device 400 may rotate to generate an air stream and the bubble generating assembly 500 may rotate to become loaded with a bubble solution simply by moving the apparatus 100 in such a manner so that the wheel 100 rotates about the first rotational axis R1. The gear assembly 600 may be configured to rotate the fan device 400 at a rotational velocity that is greater than the rotational velocity of the wheel 100. The gear assembly 600 may configured to rotate the bubble generating assembly 500 at a rotational velocity that is less than the rotational velocity of the fan device 400. In some embodiments, the bubble generating assembly 500 may rotate at the same rotational velocity as the wheel 100, although this is not required in all embodiments and the bubble generating assembly 500 could rotate faster or slower than the wheel 100. Moreover, the bubble generating assembly 500 may not rotate in all embodiments but may move in other, non-rotational ways, or not at all, as described in greater detail below.

The fan device 400 is also located within the reference cylinder RC and within the interior space 103 of the wheel 100. In the exemplified embodiment, the fan device 400 is located entirely within the interior space 103 of the wheel 100. This may be desirable to prevent any chance of injury by having a user's finger or other extremity contact the fan device 400 while it is rotating. However, in other embodiments it may be possible to position the fan device 400 only partially within the interior space 103 of the wheel 100. In any case, the fan device 400 is located within the reference cylinder RC defined by the outer surface 102 of the wheel 100.

In the exemplified embodiment, the fan device 400 is positioned within an air stream guide member 450 and the fan device 400 is coupled to one of the gears of the gear assembly 600. Thus, when the wheel 100 rotates about the first rotational axis R1, the fan device 400 will rotate about a second rotational axis R2 due to the coupling between: (1) the wheel 100 and the gear assembly 600; and (2) the fan device 400 and the gear assembly 600. As noted above, the fan device 400 and the air stream guide member 450 are located within the interior space 103 of the wheel 100 in the exemplified embodiment. Furthermore, the fan device 400 and the air stream guide member 450 are located within the reference cylinder RC on which the outer surface 102 of the wheel 100 lies. Stated another way, the fan device 400 is located radially inward from the outer surface 102 of the wheel 100, relative to the first rotational axis R1, such that no portion of the fan device 400 extends radially beyond the outer surface 102 of the wheel 100. Thus, even if the fan device 400 is not located directly inside of the interior space 103 of the wheel 100, the fan device 400 will still remain located within the reference cylinder RC.

The fan device 400 may take on any desired structure so long as the fan device 400 is configured to generate an air stream upon the fan device 400 being rotated about the second rotational axis R2. In the exemplified embodiment, the fan device 400 comprises a hub portion 401 and a plurality of blades 402 extending from the hub portion 401 (depicted in FIG. 9). Thus, as the fan device 400 rotates about the second rotational axis R2, the blades 402 will generate an air stream that will be guided by the air stream guide member 450 to the bubble generating assembly 500 as described herein with particular reference to FIG. 9. Of course, the fan device 400 is not limited to the structure shown in the drawings. Although in the exemplified embodiment there are no power sources or batteries in the apparatus 1000, in alternative embodiments the fan device may be an electrical blower that generates an air stream upon being powered on. Thus, a user may actuate a switch to activate the fan device in some embodiments if a power source were to be included in the apparatus 1000. Of course, other variations to the fan device 400 are also possible as would be appreciated by persons skilled in the art.

The air stream guide member 450 houses the fan device 400 and guides the air stream generated by the fan device 400 towards bubble generating devices 503 of the bubble generating assembly 500. In the exemplified embodiment, the air stream guide member 450 comprises a first portion 451 that is sized and shaped to receive the fan device 400 therein and a second portion 452 that is fluidly coupled to the first portion 451. The second portion 452 has a reduced cross-sectional area relative to the first portion 451 to guide the air stream to the desired location where it can flow through the bubble generating devices 503 of the bubble generating assembly 500 to generate bubbles. As will be described in greater detail below with reference to FIG. 9, during operation the air stream generated by the fan device 400 flows from the first portion 451 of the air stream guide member 450 into the second portion 452 of the air stream guide member 450, and from the second portion 452 to an opening that is aligned with the bubble generating assembly 500 so that bubbles can be produced from a bubble solution loaded on the bubble generating assembly 500.

The wheel 100 rotates on and relative to the hub assembly 200. Specifically, the hub assembly 200 is coupled to the wheel 100 and closes the first opening 104 of the wheel 100, thereby enclosing the fan device 400, the air stream guide member 450, and the gear assembly 600 within the interior space 103 of the wheel 100. In the exemplified embodiment, the hub assembly 200 comprises a reservoir component 210 and a cover plate 250 that are coupled together. However, in other embodiments the hub assembly 200 may be a unitary structure instead of being formed from multiple parts. The hub assembly 200 defines a reservoir 201 for holding a supply of a bubble solution that is used to generate or produce bubbles during use of the apparatus 100. The reservoir 201 is formed by a floor 202 and a sidewall 203 of the hub portion 200. More specifically, the reservoir component 210 comprises the floor 202 and a first portion 203*a* of the sidewall 203 and the cover plate 250 comprises a second portion 203*b* of the sidewall 203. Thus, the reservoir 201 is formed between the cover plate 250 and the reservoir component 210.

The hub assembly 200, and more specifically the reservoir component 210, comprises a reservoir portion 211 and an attachment portion 212. The attachment portion 212 extends from the reservoir portion 211 so that a tunnel portion 213 is formed between the attachment portion 212 and the reservoir portion 211. Specifically, the attachment portion 212 forms an arch that extends from the reservoir portion 211 and thereby defines the tunnel portion 213 of the reservoir component 210. The hub assembly 200 is coupled to the wheel 100 so that the wheel 100, or a portion thereof, is always located within the tunnel portion 213. Specifically, the attachment portion 212 extends around a portion of the wheel 100 so that the wheel 100 is sandwiched or trapped between the reservoir portion 211 and the attachment portion 212 of the reservoir component 210. The tunnel portion 213 has a cross-sectional area that is greater than the cross-sectional area of the wheel 100 so that the wheel 100 is capable of freely rotating relative to the hub portion 200. As the wheel 100 rotates about the first rotational axis R1, the specific portion of the wheel 100 that is located within the tunnel portion 213 of the reservoir component 210 will change. However, a portion of the wheel 100 will always remain within the tunnel portion 213 so long as the hub assembly 200 is coupled to the wheel 100.

The reservoir portion 211 of the reservoir component 210 comprises a body portion 214 that includes the floor 202 and the first portion 203*a* of the sidewall 203 of the reservoir 201 and a collar portion 215 that extends from the body portion 214. The tunnel portion 213 is formed between the attachment portion 212 and the collar portion 215 of the reservoir portion 211. During use, the wheel 100 rotates along the collar portion 215 of the reservoir portion 211 of the reservoir component 210.

The hub assembly 200 comprises a second opening 216 formed into the first portion 203*a* of the sidewall 203 of the reservoir component 210. As will be described in greater detail below, the air stream generated by the fan device 400 is configured to flow through the second opening 216. Furthermore, the bubble generating devices 503 of the bubble generating assembly 500 are configured to become aligned with the second opening 216 so that the air stream can flow therethrough for the production of bubbles. In the exemplified embodiment, the second opening 216 may have a diameter that is less than or equal to a diameter of the bubble generating devices 503 of the bubble generating assembly 500. Thus, the opening 216 forms a discrete region through which the air stream can flow to the bubble generating devices 503.

As mentioned above, the cover plate 250 is coupled to the reservoir component 210 so that the reservoir 201 is formed between the cover plate 250 and the reservoir component 210. In the exemplified embodiment, the cover plate 250 comprises a third opening 251 that forms a passageway between the ambient environment and the reservoir 201. In the exemplified embodiment, the third opening 251 is arcuate in shape, although the invention is not to be so limited in all embodiments. Furthermore, the third opening 251, or at least a portion thereof, is aligned with the second opening 216 in the reservoir component 210 of the hub assembly 200. Thus, the air stream flows through the second opening 216 and through the bubble generating devices 503 to produce bubbles, and the bubbles are then able to flow through the third opening 250 in the cover plate 250 to the ambient environment.

The cover plate 250 also comprises a fourth opening 252 and a cap 253 for closing the fourth opening 252. The fourth opening 252 also provides a passageway from the exterior/ambient environment into the reservoir 201. The cap 253 is removably coupled to the cover plate 250 between an attached state (FIG. 3) and a detached state FIGS. 2 and 6. The cap 253 may be coupled to the cover plate 250 using threaded screws, interference fit, mechanical couplers, or the like. In use, the cap 253 is detached from the cover plate 250 to expose the fourth opening 252. Then, a user can pour a bubble solution into the reservoir 201 through the fourth opening 252 in the cover plate 253. Thus, the fourth opening 252 operates as a refill opening so that the bubble solution can be filled and refilled into the reservoir 201. The bubble solution can also be removed from the reservoir 201 through the fourth opening 252 if it is not all used up after a play session (although he bubble solution can simply be stored in the reservoir 201 until a user desires to use the apparatus 1000 again. In some embodiments, the fourth opening 252 could be omitted and filling/refilling the reservoir 201 with the bubble solution can take place through the third opening 251.

In the exemplified embodiment, the bubble generating assembly 500 is located within the reservoir 201. Specifically, the bubble generating assembly 500 is located within the space formed between the reservoir component 210 and the cover plate 250 of the hub assembly 200. Furthermore, the bubble generating assembly 500 is located within the reference cylinder RC defined by the outer surface 102 of the wheel 100 or on which the outer surface 102 of the wheel 100 lies. In the exemplified embodiment, the bubble generating assembly 500 is positioned, in its entirety, within the reference cylinder RC. Thus, no portion of the bubble generating assembly 500 extends past or protrudes through the reference cylinder RC. Stated yet another way, the bubble generating assembly 500 is positioned radially inward of the outer surface 102 of the wheel 100 relative to the first rotational axis R1.

Thus, in the exemplified embodiment all of the components needed for bubble generation are located within the wheel 100 or within the reference cylinder RC that is parallel to the rotational axis R1 of the wheel 100. Thus, during use the bubbles are formed within the wheel 100 itself, and not at some other location along the apparatus 1000. The rotation of the wheel 100 causes bubble generating, and the generated bubbles are formed within and then flow out of the wheel 100.

Figure 4B:
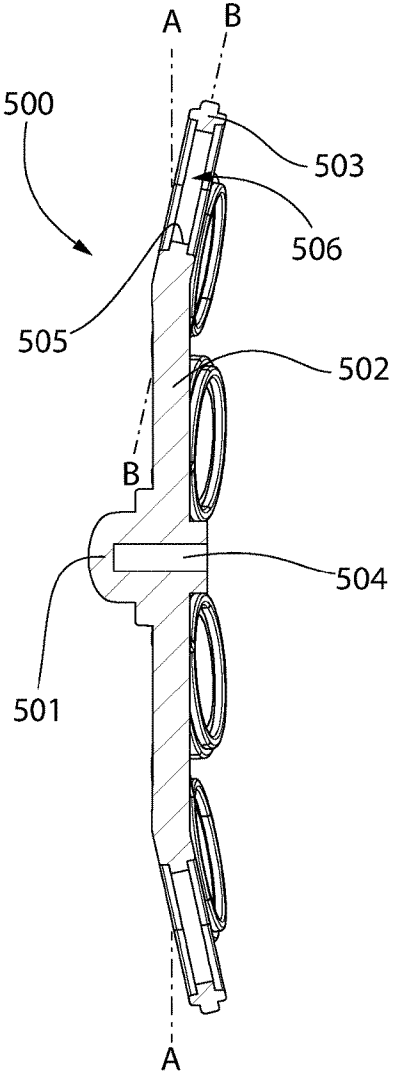
FIG. 4B is a cross-sectional view taken along line IVB-IVB of FIG. 4A.
Figure 4A:
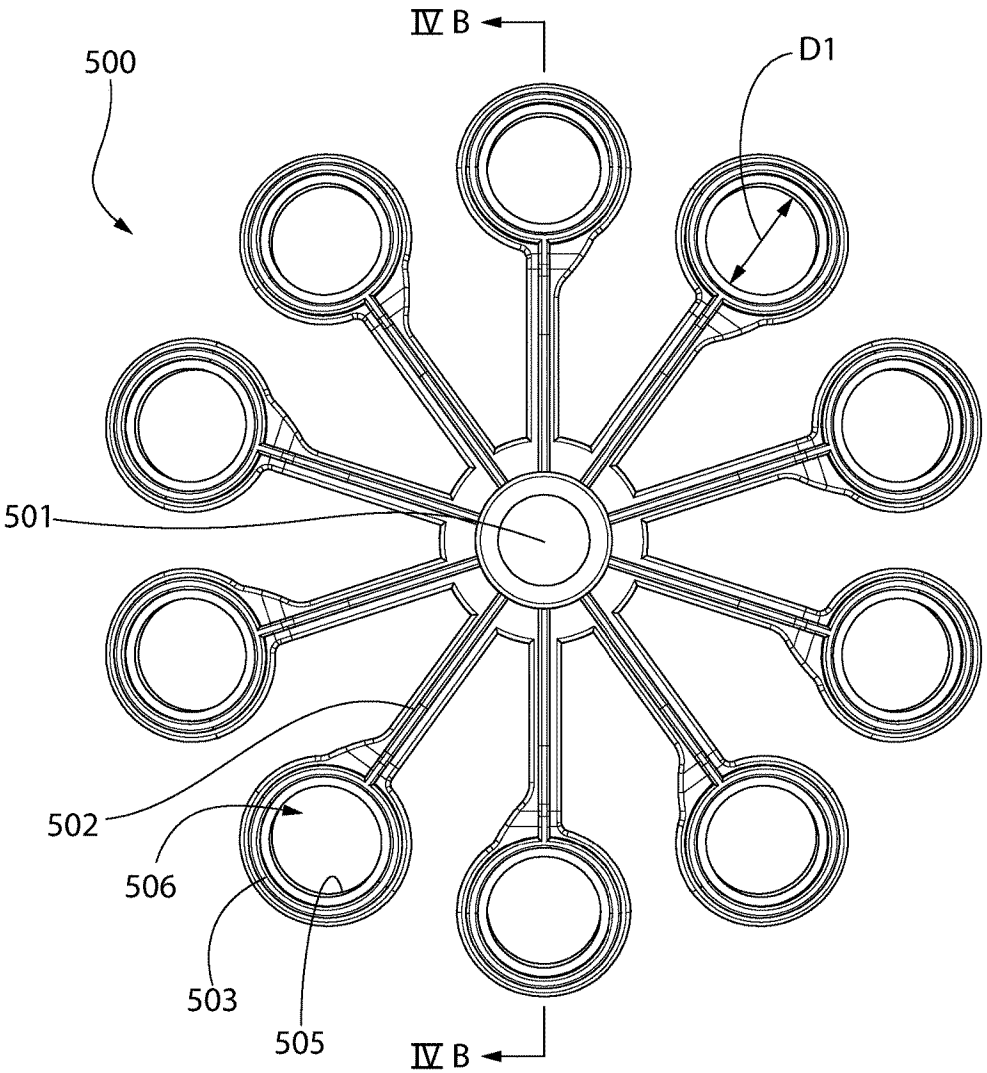
FIG. 4A is a front view of a bubble generating assembly of the apparatus of FIG. 1.

Referring briefly to FIGS. 4A and 4B, the structure of the bubble generating assembly 500 will be described. The bubble generating assembly 500 generally comprises a hub portion 501, a plurality of arm members 502 extending radially from the hub portion 501, and one of the bubble generating devices 503 coupled to a distal end of each of the arm members 502. In the exemplified embodiment, each of the bubble generating devices 503 extends obliquely from the arm member 502 to which it is attached. Thus, taking one of the arm members 502 as an example, the arm member 502 extends along an axis A-A and the bubble generating device 503 attached to that arm member 502 extends along an axis B-B, the axis B-B being oblique to the axis A-A. More specifically, the angle between the axes A-A, B-B is an acute angle. As seen in FIG. 4B, the hub portion 501 of the bubble generating assembly 500 comprises a recess 504 for receiving a shaft of a gear of the gear assembly 600 to operably couple the bubble generating assembly 500 to the gear assembly 600.

Each of the bubble generating devices 503 is a ring-shaped structure having an inner surface 505 that defines a central aperture 506. Of course, the shape need not be circular in all embodiments. The ring structure 505 has an inner diameter D1 defined by the inner surface 505 (the inner diameter D1 being the diameter of the central aperture 506). As mentioned above, the inner diameter D1 may be equal to or greater than the diameter of the second opening 216 in the hub assembly 200. Although not shown in the exemplified embodiment, there may be ribs, notches, or the like provided on the inner surface 505 of the ring structure 505 to enhance the attachment of the bubble solution to the bubble generating devices 503 during operation of the apparatus 1000.

Referring again to FIGS. 1-3 and 6, the bubble generating assembly 500 is located within the reservoir 201 of the hub assembly 200 and is operably coupled to the gear assembly 600. Thus, as the wheel 100 rotates about the first rotational axis R1, the bubble generating assembly 500 rotates about a third rotational axis R3. In the exemplified embodiment, the third rotational axis R3 is the same as the first rotational axis R1, but in other embodiments the third rotational axis R3 could be parallel to and offset from the first rotational axis R1. In the exemplified embodiment, rotation of the wheel 100 about the first rotational axis R1 may be configured to load the bubble generating devices 503 of the bubble generating assembly 500 with the bubble solution. In the exemplified embodiment, this occurs by the bubble generating assembly 500 rotating about the third rotational axis R3, which causes the bubble generating devices 503 to rotate into and out of the bubble solution in the reservoir 201. As the bubble generating devices 503 rotate through the bubble solution in the reservoir 201, the bubble generating devices 503 become loaded with the bubble solution. Specifically, the bubble solution forms a film that covers or spans across the central apertures 506 of the bubble generating devices 503, and this film ultimately turns to bubbles as air from the fan device 400 flows through the central apertures 506.

Although rotation of the bubble generating assembly 500 is the way that the bubble generating devices 503 become loaded with the bubble solution in the exemplified embodiment, the invention is not to be so limited in all embodiments. In other embodiments, loading of the bubble generating devices 503 with the bubble solution may occur by the bubble generating assembly 500 moving linearly or in another non-rotatable manner. In still other embodiments the loading of the bubble generating devices 503 with the bubble solution may occur by the bubble solution being pumped to the bubble generating devices 503. For example, rotation of the wheel 100 may activate a pump that pumps the bubble solution from the reservoir 201 to the bubble generating devices 503. Such a pump may be a peristaltic pump in some embodiments, although other types of pumps may also be used (i.e., centrifugal pumps, rotary pumps, reciprocating pumps, piston pumps, diaphragm pumps, gear pumps, or the like). In still other embodiments, a motor and power source may be included to initiate rotation of the bubble generating assembly 500 for loading the bubble generating devices 503 with the bubble solution. However, as mentioned above, in the preferred embodiment there is no power source and there is no motor.

Referring again to the exemplary embodiment, as the bubble generating assembly 500 rotates about the rotational axis R1, the bubble generating devices 503 rotate into and out of the bubble solution that is located along the bottom portion of the reservoir 201. As the bubble generating devices 503 rotate out of the bubble solution, the bubble generating devices 503 becomes visible through the third opening 251 (which may also be referred to as a window). Thus, a user can watch the bubble generating assembly 500 rotate about the third rotational axis R3 through the third opening 251 in the cover plate 250. As the bubble generating devices 503 loaded with the bubble solution pass by the third opening 251 in the cover plate 250, the air stream generated by the fan device 400 flows through the bubble generating devices 503 via the second opening 216 in the reservoir component 210 and produces bubbles that can then flow out to the ambient environment through the third opening 251.

In the exemplified embodiment, rotation of the wheel 100 about the rotational axis R1 is configured to load the bubble solution onto the bubble generating devices 503 of the bubble generating assembly 500, rotate the fan device 400 about the second rotational axis R2 to generate an air stream, or both. As a general matter and to provide a general understanding, the wheel 100 rotates about the first rotational axis R1 in use but the hub assembly 200 does not also rotate. Although it is possible for the hub assembly 200 to also rotate, it does not do so as a result of the rotation of the wheel 100. Rather, the wheel 100 rotates relative to and around the hub assembly 200 during use and the hub assembly 200 may be stationary during the rotation of the wheel 100. It should be appreciated that the hub assembly 200 may also be capable of rotating or pivoting due to a user moving the handle assembly 300, which is coupled to the hub assembly 200, as described in more detail below. However, the rotation of the wheel 100 by itself does not cause any movement of the hub portion 200.

The handle assembly 300 comprises a pair of rod members 301 coupled to and extending from the attachment portion 212 of the reservoir component 210 of the hub assembly 200. The rod members 301 extend from the hub assembly 200 to a dashboard 302. A first handle 303 and a second handle 304 extend from the dashboard 302 in generally opposite directions. The first and second handles 303, 304 may include grips or the like to enhance comfort to a user. During use of the apparatus 1000, a user such as a child will grip the first and second handles 303, 304 with his/her hands to operate/manipulate/move the apparatus 100. Specifically, the user can grip the handles 303, 304 and push forward, thereby causing the wheel 100 to rotate in a clockwise direction. The user can alternatively pull the apparatus 100 backwards, thereby causing the wheel 100 to rotate in a counter-clockwise direction. In either case, the apparatus 100 may generate bubbles as a result of rotation of the wheel 100 as described herein. A user may also be able to pivot the handle assembly 300 upwardly and downwardly which will cause the hub assembly 200 to rotate/pivot relative to the wheel 100. This may be done to accommodate users of different height (the handle assembly 300 being pivoted downwardly for a shorter user and pivoted upwardly for a taller user).

Figure 5A:
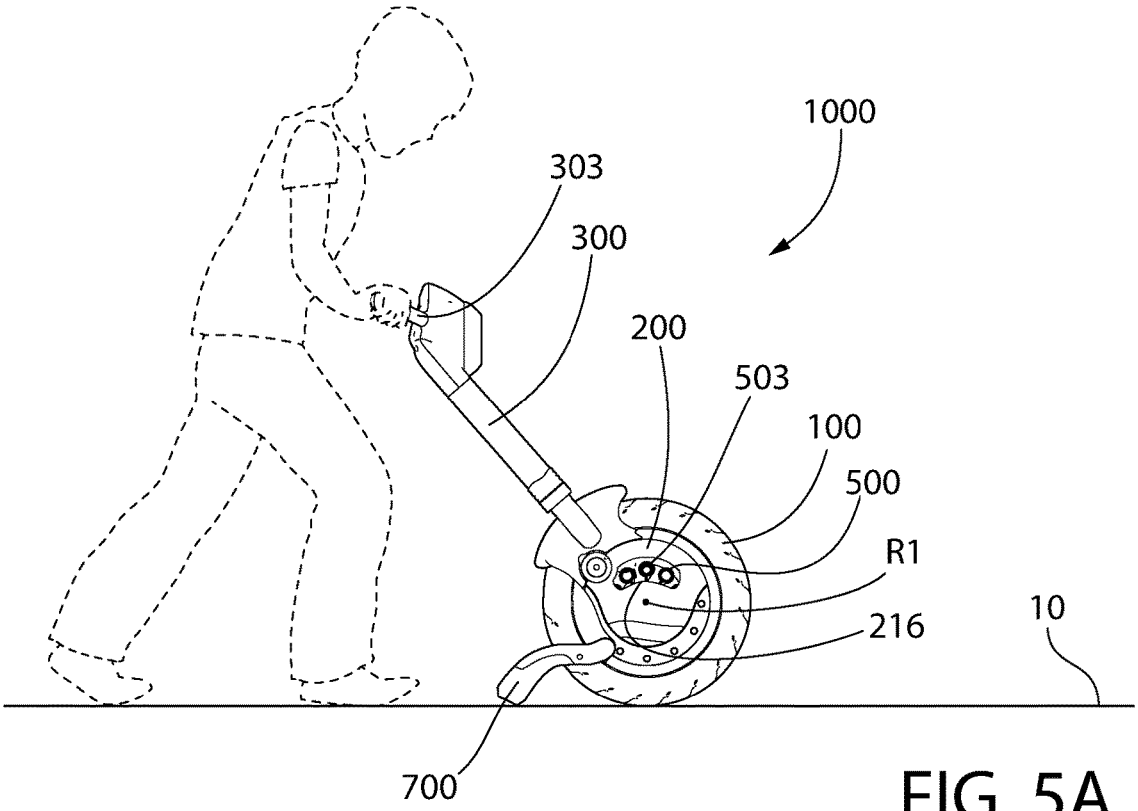
FIGS. 5A and 5B are schematic illustrations of the apparatus of FIG. 1 in use.
Figure 5B:
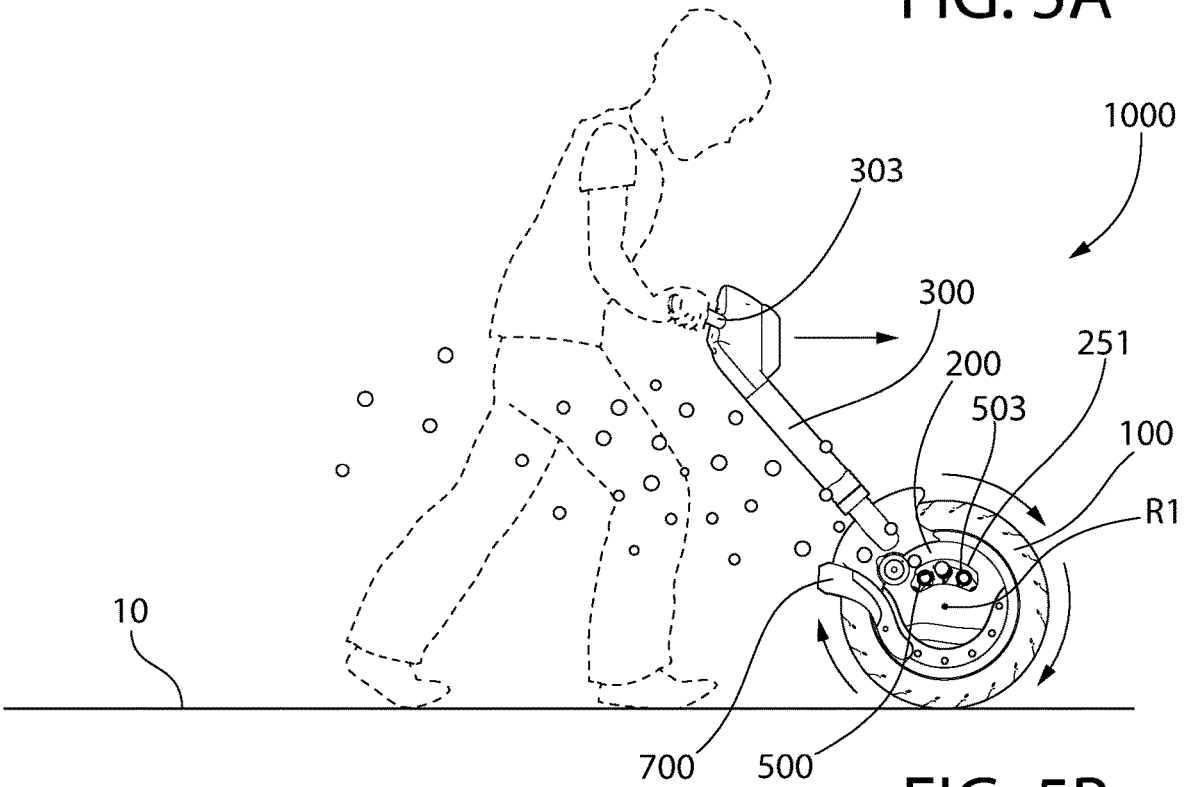

Referring to FIGS. 5A and 5B, the apparatus 1000 is depicted in use. During typical use of the apparatus 1000, the wheel 100 is placed into contact with a ground surface 10, such as a floor in an interior environment or a driveway, street, patio, grass, or the like in an outdoor environment. A user then grips the handles 303, 304 and moves the apparatus 1000 along the ground surface 10, which causes the wheel 100 to rotate about the first rotational axis R1. As a result and in direct response to the rotation of the wheel 100 about the first rotational axis R1, the bubble generating assembly 500 rotates about the third rotational axis R3 and the fan device 400 rotates about the second rotational axis R2. Thus, in direct response to the rotation of the wheel 100 about the first rotational axis R1, the fan device 400 generates an air stream that flows through the second opening 216 in the hub assembly 200. At the same time, the bubble generating assembly 500 rotates about the third rotational axis R3 (which in the exemplified embodiment is the same as the first rotational axis R1) so that the bubble generating devices 503 move into the bubble solution in the reservoir 201 and then move into alignment with the second opening 216 in the hub assembly 200. As the air stream generated by the fan device 400 flows out through the second opening 216, it passes through the bubble generating devices 503 that are loaded with the bubble solution to produce bubbles that then flow out through the third opening 251 and into the ambient environment. The details of this operation and the internal workings of the components will be described further below with reference to FIGS. 6-10.

Although the description above is related to use by moving the apparatus 1000 along the ground surface 10, it should be appreciated that simply rotating the wheel 100 by hand will achieve the same results. Moreover, as mentioned above, although in the exemplified embodiment rotation of the wheel 100 causes rotation or movement of the bubble generating assembly 500 and of the fan device 400, this is not required in all embodiments. In other embodiments rotation of the wheel 100 may cause either movement of the bubble generating assembly 500 or movement of the fan device 400. In still other embodiments, rotation of the wheel 100 may cause the bubble generating devices 503 to become loaded with the bubble solution whether or not the bubble generating assembly 500 is made to move. Thus, variations are possible and the invention should be construed in terms of the scope set forth in the claims.

FIGS. 5A and 5B also illustrate the functionality of the kickstand 700. As mentioned above, the kickstand 700 is pivotably or rotatably coupled to the hub assembly 200 so that the kickstand 700 can be adjusted between: (1) a first position, shown in FIG. 5A, in which the kickstand 700 contacts the ground surface 10 and supports the apparatus 1000 in an upright position; and (2) a second position, shown in FIG. 5B, in which the kickstand 700 does not contact the ground surface 10. Thus, when the apparatus 1000 is not being used, a user can place the kickstand 700 into the first position and the kickstand 700 will support the apparatus 1000 in the upright position. This is important because a user may decide to stop using the apparatus 1000 before all of the bubble solution in the reservoir 201 is depleted. As such, resting the apparatus 1000 on the ground may cause some of the bubble solution to spill out of the reservoir 201, creating a mess. By using the kickstand 700, this can be avoided. Altering the kickstand 700 between the first and second positions is simple, quite similar to the same process on a bicycle or motorcycle. Of course, in some embodiments the kickstand 700 may be omitted as it is not essential to operation of the apparatus 1000.

Figure 6:
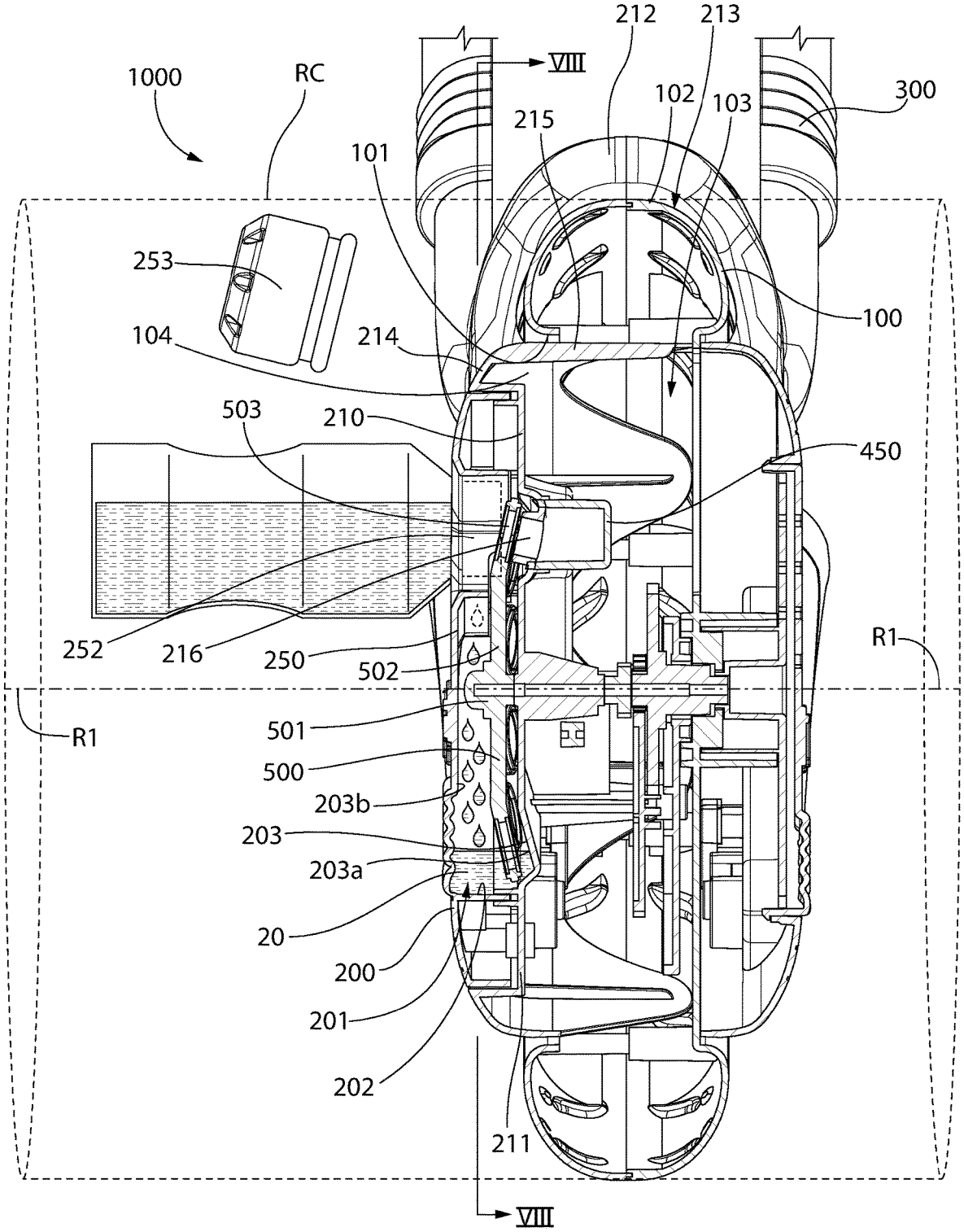
FIG. 6 is a cross-sectional view taken along line VI-VI of FIG. 1 and illustrating bubble solution being poured into a reservoir of the apparatus.

Next, the operation of the apparatus 1000 will be described in greater detail. Referring to FIG. 6, the first step in the operation of the apparatus 1000 is for a user to detach the cap 253 from the cover plate 250 to expose the fourth opening 252. Next, a user pours a bubble solution into the reservoir 201 through the fourth opening 252. In FIG. 6, this is accomplished by positioning a neck of a bottle containing bubble solution into the fourth opening 252 so that the bubble solution pours out and into the reservoir 201. There are other ways that this can be achieved, such as by using a funnel or by directly pouring the bubble solution into the reservoir 201 without inserting the neck of the bottle through the fourth opening 252. No matter how this is done, the result is that a supply of the bubble solution 20 fills a bottom portion of the reservoir 201. The apparatus 1000 may come with instructions to inform a user of the maximum volume of bubble solution that should be put into the reservoir 201 at one time. Alternatively, there may be a fill line or another window on the cover plate 250 to indicate to a user when the reservoir 201 is full. The reservoir 201 should have a sufficient volume of the bubble solution 20 so that the bubble generating devices 503 are completely submerged in the supply of the bubble solution 20 as they pass through it during rotation of the bubble generating assembly 500.

Figure 7:
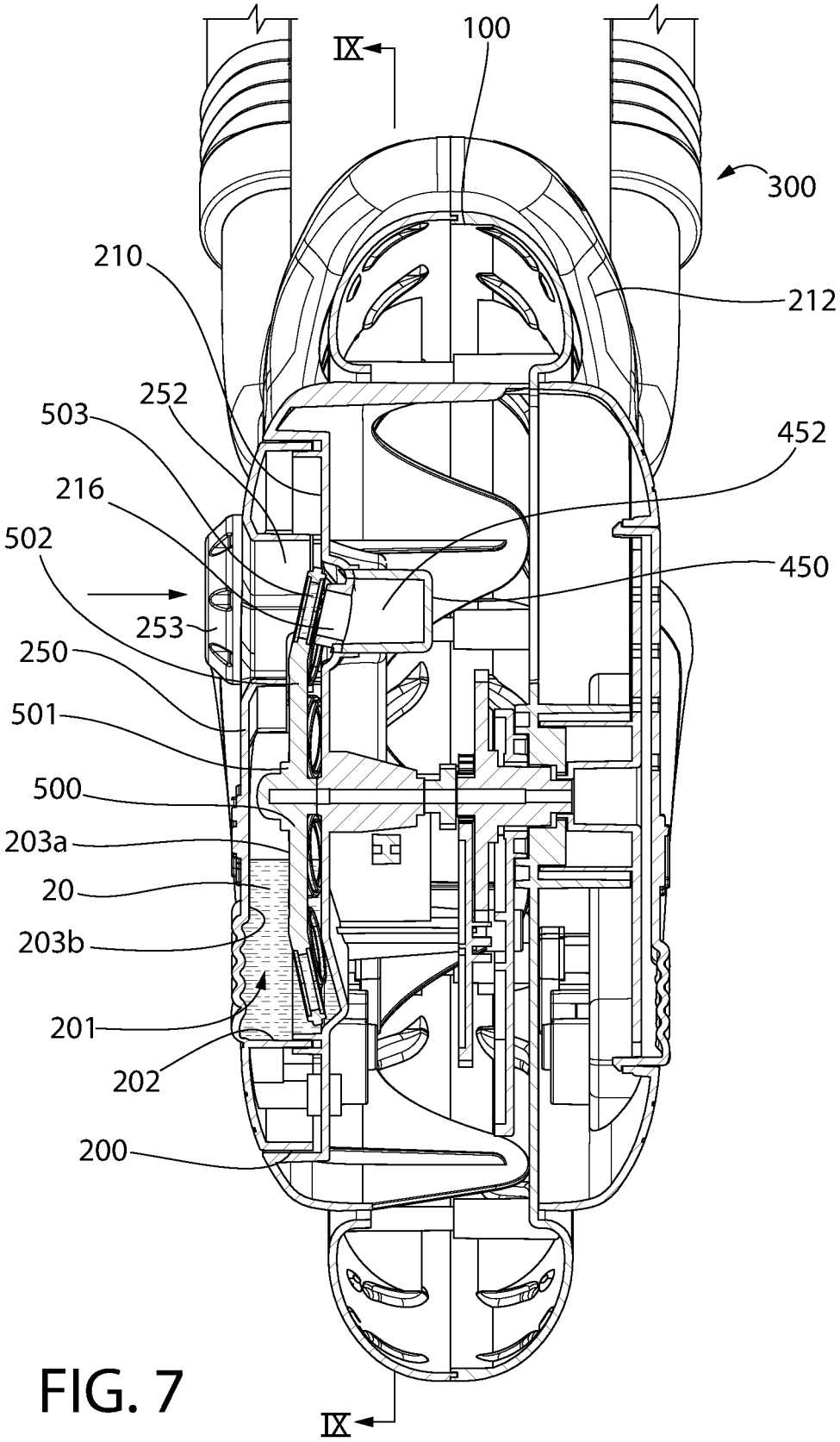
FIG. 7 is the cross-sectional view of FIG. 6 illustrating a cap being placed to close the reservoir.

Referring to FIG. 7, once the reservoir 201 is filled to a desired level, the cap 253 is coupled to the cover plate 250 to close the fourth opening 253. The fan device 400 is not visible in FIG. 7, but the second portion 452 of the air stream guide member 450 is visible. Viewing FIGS. 3 and 7-10 collectively should give a person skilled in the art an understanding of the operation of the apparatus 1000, which will be described further below.

After the supply of the bubble solution 20 has been placed into the reservoir 201 and the cap 253 has been coupled to the cover plate 250 of the hub assembly 200, the apparatus 1000 is ready for use to generate bubbles. Thus, at this stage a user can push or pull the apparatus 1000 across the ground surface 10 as described above with reference to FIGS. 5A and 5B, with the result being that bubbles are generated that flow outwardly away from the apparatus 1000 via the fourth opening or window 251. The process that takes place when the user pushes or pulls the apparatus 1000 across the ground surface 10 will be described in greater detail with reference to FIGS. 8-10.

Figure 8:
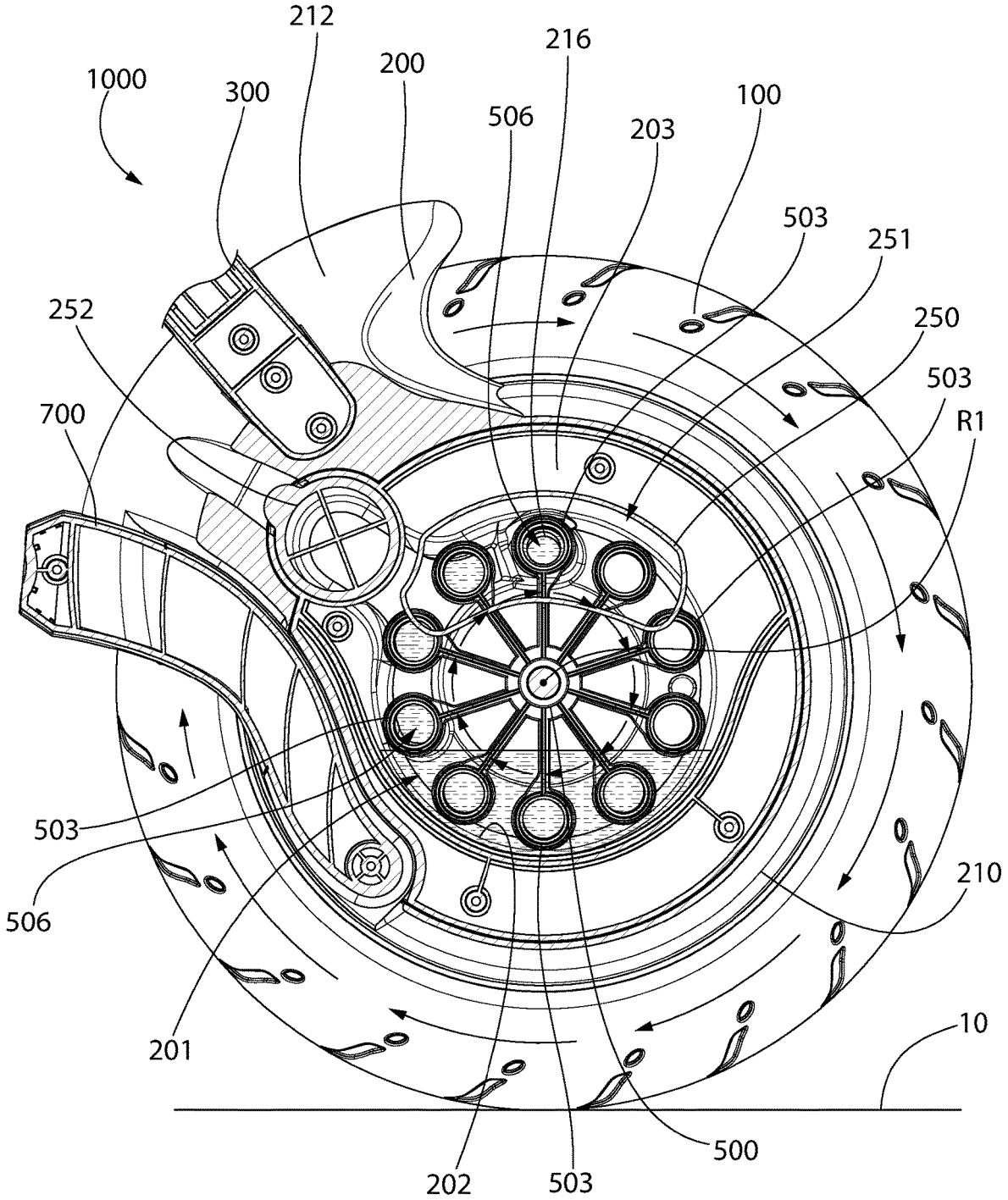
FIG. 8 is a cross-sectional view taken along line VIII-VIII of FIG. 6.

Referring to FIG. 8, the arrows along the wheel 100 illustrate that the wheel 100 is rotating about the first rotational axis R1 in a clockwise direction across the ground surface 10. Of course, the apparatus 1000 may work in a similar fashion regardless of whether the wheel 100 is rotating in a clockwise or a counterclockwise direction. In the exemplified embodiment, as the wheel 100 rotates about the first rotational axis R1 in the clockwise direction, the bubble generating assembly 500 also rotates about the first rotational axis R1 in the clockwise direction. Of course, it is possible in alternative embodiments for the bubble generating assembly 500 to rotate in the opposite direction than the wheel 100. Furthermore, in alternative embodiments the bubble generating assembly 500 may rotate about an axis that is different than the first rotational axis R1, such as an axis that is spaced apart from and parallel to the first rotational axis R1. The bubble generating assembly 500 is made to rotate due to its coupling to the gear assembly 600, which is also coupled to the wheel 100. Thus, the bubble generating assembly 500 is indirectly coupled to the wheel 100 via the gear assembly 600, which ensures that the bubble generating assembly 500 rotates (or moves, depending on the embodiment) as the wheel 100 rotates.

As the bubble generating assembly 500 rotates about the first rotational axis R1, the bubble generating devices 503 of the bubble generating assembly 500 move into the bottom portion of the reservoir 201 within which the supply of the bubble solution 20 is located. As the bubble generating devices 503 pass through the bubble solution 20, the bubble solution 20 adheres to the bubble generating devices 503 and forms a film of the bubble solution that extends across the central apertures 506 of the bubble generating devices 503. A bubble generating device 503 that has the bubble solution adhered thereto may be described herein as being loaded with the bubble solution.

As the bubble generating assembly 500 continues to rotate about the first rotational axis R1, the bubble generating devices 503 that are loaded with the bubble solution eventually pass by the second opening 216. As seen best in this figure, the second opening 216 has a diameter that is equal to or less than the diameter of the bubble generating devices 216 so that all of the air flowing out of the second opening 216 flows through the central aperture 506 of the bubble generating device 216 as it passes the second opening 216. As discussed above and described in greater detail below, the air stream generated by the fan device 400 flows through the second opening 216. Thus, as the air stream flows through the second opening 216 the air stream will pass through the bubble generating devices 503 that are loaded with the bubble solution, which will cause bubbles to be formed from the bubble solution. Those bubbles will then flow out through the third opening 251 in the cover plate 250.

Figure 9:
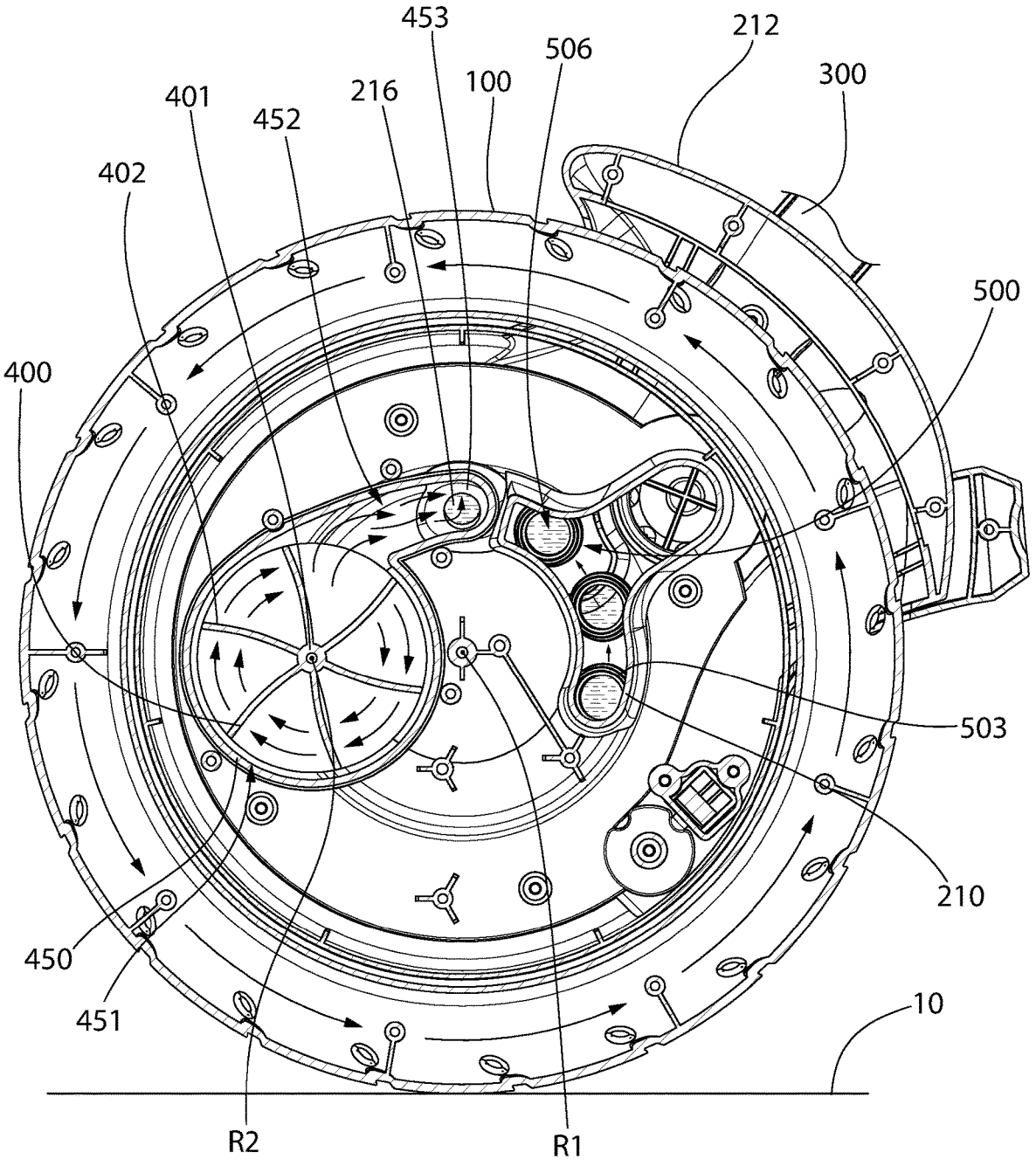
FIG. 9 is a cross-sectional view taken along FIG. IX-IX of FIG. 7.

Referring to FIG. 9, the apparatus 1000 is illustrated at the same moment in time as FIG. 8, except from the reverse side so that the fan device 400, which is hidden behind the reservoir component 210 in FIG. 8, is visible. As noted above, the fan device 400 is positioned within the first portion 451 of the air stream guide member 450. The fan device 400 is operably coupled to the gear assembly 600 so that as the wheel 100 rotates about the first rotational axis R1, the fan device 400 rotates about the second rotational axis R2. In the exemplified embodiment, the wheel 100 and the fan device 400 are rotating in opposite directions, but they could rotate in the same direction in other embodiments.

As the fan device 400 rotates, it generates an air stream. As shown with the arrows in FIG. 9, the air stream is forced, by the air stream guide member 450, to flow into the second portion 452 of the air stream guide member 450. The second portion 452 of the air stream guide member 450 has an outlet portion 453 that is aligned with the second opening 216. Thus, the air stream flows through the second portion 452 of the air stream guide member 450, out of the outlet portion 453, and through the second opening 216, where it then flows through the central apertures 506 of the bubble generating devices 503 as described above.

To reiterate, in the exemplified embodiment the wheel 100, the fan device 400, and the bubble generating assembly 500 are all operably coupled to the gear assembly 600. Thus, when the wheel 100 is made to rotate about the first rotational axis R1, this causes a driver gear to rotate. The driver gear is coupled to other gears in the gear assembly 600, which causes those other gears to rotate. If the other gears are larger than the driver gear, then they will rotate slower than the driver gear. If the other gears are smaller than the driver gear, then they will rotate faster than the driver gear. The fan device 400 is coupled to one of the other gears that is smaller than the driver gear so that the fan device 400 rotates faster than the wheel 100. The bubble generating assembly 500 is coupled to another one of the gears and such gear may be smaller than, the same size as, or larger than the driver gear so that the bubble generating assembly 500 may rotate slower, faster, or at the same speed as the wheel 100. At any rate, in the exemplified embodiment rotation of the wheel 100 about the first rotational axis R1 directly causes the bubble generating assembly 500 to rotate to become loaded with the bubble solution and directly causes the fan device 400 to rotate to generate the air stream. Thus, by rotating the wheel 100, the apparatus 100 can generate bubbles as long as there is a sufficient amount of the bubble solution present in the reservoir 201.

Figure 10:
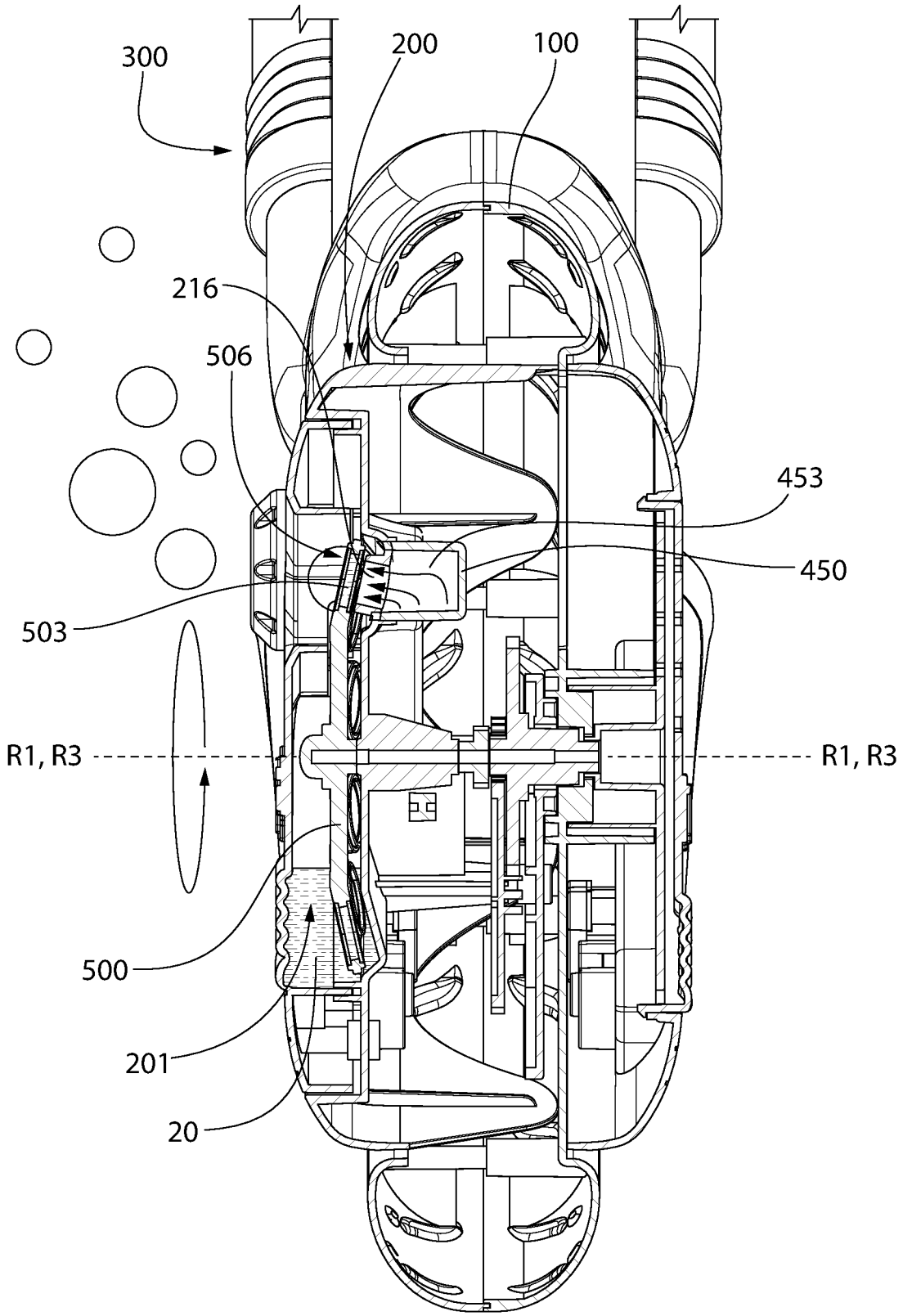
FIG. 10 is the cross-sectional view of FIG. 6 illustrating bubbles being generated.

FIG. 10 illustrates the result of operation of the apparatus 1000. Specifically, FIG. 10 shows the air stream flowing out of the outlet portion 453 of the air stream guide member 450, through the second opening 216 in the hub assembly 200, and through the central aperture 506 of the bubble generating device 503 that is loaded with the bubble solution. As a result, bubbles are formed from the bubble solution. Thus, if there is a supply of the bubble solution 20 in the reservoir 201 and the apparatus 1000 is used by rotating the wheel 100 such as by moving the apparatus 1000 with the wheel in contact with a ground surface, bubbles will be formed.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An apparatus for generating bubbles comprising:

a wheel having an outer surface that lies on a reference cylinder, the wheel configured to rotate about a first rotational axis;

a fan device located within the reference cylinder, the fan device operably coupled to the wheel by a gear assembly and configured to generate an air stream;

a bubble generating assembly located within the reference cylinder, the bubble generating assembly comprising at least one bubble generating device;

a hub assembly comprising a reservoir portion that comprises a reservoir for holding a supply of a bubble solution, the reservoir portion of the hub assembly located within the reference cylinder;

wherein the wheel is configured to rotate relative to the hub assembly around the reservoir portion of the hub assembly; and wherein the wheel is operably coupled to the fan device and to the bubble generating assembly so that upon rotation of the wheel about the first rotational axis: (1) the bubble generating assembly rotates about a third rotational axis to load the bubble solution onto the at least one bubble generating device; and (2) the fan device rotates about a second rotational axis to generate the air stream.

2. The apparatus according to claim 1 wherein the reservoir portion of the hub assembly comprises a collar portion, and wherein the wheel rotates around the collar portion of the reservoir portion of the hub assembly while the hub assembly remains stationary.

3. The apparatus according to claim 1 wherein the first and third rotational axes are the same and wherein the second rotational axis is parallel to the first and third rotational axes, and wherein gear assembly causes the fan device to rotate faster than the wheel.

4. The apparatus according to claim 1 wherein the bubble generating assembly comprises a plurality of the bubble generating devices, and wherein rotation of the wheel causes the bubble generating assembly to rotate about the first rotational axis to repetitively load the bubble solution onto the bubble generating devices and align the bubble generating devices that are loaded with the bubble solution with the air stream generated by the fan device to produce bubbles.

5. The apparatus according to claim 4 wherein during rotation of the bubble generating assembly each of the bubble generating devices passes through the supply of the bubble solution in the reservoir to become loaded with the bubble solution and then becomes aligned with an opening through which the air stream flows.

6. The apparatus according to claim 1 wherein the bubble generating assembly comprises a hub portion, a plurality of arm members extending radially from the hub portion, and one of the bubble generating devices coupled to a distal end of each of the arm members, wherein each of the bubble generating devices extends obliquely from the arm member to which it is coupled.

7. The apparatus according to claim 1 wherein the wheel comprises an inner surface that defines an interior space and a first opening that forms a passageway into the interior space, the fan device at least partially located within the interior space of the wheel, wherein the hub assembly closes the first opening of the wheel, the hub assembly comprising a floor and a sidewall that define the reservoir, the sidewall of the hub assembly having a second opening, and wherein the air stream generated by the fan device flows through the second opening in the sidewall of the hub assembly and then through the bubble generating device of the bubble generating assembly to produce bubbles from the bubble solution loaded on the bubble generating device.

8. The apparatus according to claim 7 wherein the hub assembly comprises a reservoir component and a cover plate that is coupled to the reservoir component, the reservoir component comprising the floor and a first portion of the sidewall and the cover plate comprising a second portion of the sidewall, the second opening being formed in the first portion of the sidewall and the cover plate having a third opening that is aligned with the second opening, wherein the bubbles flow through the third opening and away from the wheel.

9. The apparatus according to claim 8 wherein the bubble generating assembly is located within the reservoir of the hub assembly between the cover plate and the reservoir component.

10. The apparatus according to claim 1 wherein rotation of the wheel does not cause rotation of the hub assembly.

11. The apparatus according to claim 1 further a handle assembly coupled to the hub assembly so that movement of the handle assembly relative to the wheel causes the hub assembly to rotate relative to the wheel, wherein the handle assembly comprises at least one rod member extending from the hub assembly to a dashboard along an axis that is perpendicular to the first rotational axis of the wheel and first and second handles extending from the dashboard in opposite directions for gripping by a user so that the user can push the apparatus with the wheel in contact with a ground surface, thereby causing the wheel to rotate about the first rotational axis.

12. The apparatus according to claim 1 further comprising a kickstand coupled to the hub assembly, the kickstand adjustable between: (1) a first position in which the kickstand contacts a ground surface and supports the apparatus in an upright position; and (2) a second position in which the kickstand does not contact the ground surface.

13. The apparatus according to claim 1 wherein the hub assembly comprises an attachment portion that extends from the reservoir portion and surrounds a portion of the outer surface of the wheel so that the attachment portion is at least partially located outside of the reference cylinder, the attachment portion forming a tunnel through which the wheel rotates.

14. The apparatus according to claim 1 wherein the wheel comprises an inner surface that defines an interior space, and wherein the reservoir and the bubble generating assembly are located outside of the interior space.

15. An apparatus for generating bubbles comprising:

a wheel that is rotatable about a first rotational axis;

a reservoir for holding a supply of a bubble solution;

a fan device operably coupled to the wheel by a gear assembly, the fan device and the gear assembly located within the wheel;

a bubble generating assembly operably coupled to the wheel and located within the reservoir, the bubble generating assembly comprising at least one bubble generating device;

wherein rotation of the wheel about the first rotational axis causes: (1) the fan device to rotate about a second rotational axis to generate an air stream; and (2) the bubble generating assembly to rotate about the first rotational axis to load the bubble solution onto the bubble generating device and then align the bubble generating device that is loaded with the bubble solution with the air stream to generate bubbles; and wherein the wheel rotates relative to the reservoir as the wheel is rotated about the first rotational axis.

16. The apparatus according to claim 15 wherein the wheel has an outer surface, and wherein the fan device and the bubble generating assembly are located radially inward from the outer surface of the wheel.

17. The apparatus according to claim 15 wherein the first and second rotational axes are parallel to one another.

18. The apparatus according to claim 15 further comprising a hub assembly coupled to the wheel, the hub assembly comprising the reservoir, wherein the bubble generating assembly is located within the reservoir of the hub assembly, and wherein the wheel rotates around a portion of the hub assembly.

19. A bubble generating toy comprising:

a wheel that is configured to rotate about a first rotational axis, the wheel having an inner surface that defines an interior space;

a hub assembly coupled to the wheel, the hub assembly comprising:

a reservoir portion comprising a reservoir containing a supply of a bubble solution and a collar portion extending from the reservoir portion;

an attachment portion that extends from the reservoir portion and wraps around a portion of the wheel so that the portion of the wheel is positioned between the attachment portion and the reservoir portion; and a cover plate coupled to the reservoir portion and forming a sidewall that at least partially bounds the reservoir, the cover plate comprising an opening that forms a passageway between the ambient environment and the reservoir;

a handle assembly coupled to the attachment portion of the hub assembly so that movement of the handle assembly causes the hub assembly to rotate relative to the wheel, wherein the handle assembly is configured to be gripped by a user so that the user can push the bubble generating toy with the wheel in contact with a ground surface, thereby causing the wheel to rotate about the first rotational axis relative to the hub assembly around the collar portion of the hub assembly;

a fan device located within the interior space of the wheel, wherein the fan device is operably coupled to the wheel by a gear assembly so that rotation of the wheel about the first rotational axis causes the fan device to generate an air stream; and a bubble generating assembly comprising a plurality of bubble generating devices located within the reservoir of the hub assembly, wherein the bubble generating assembly is operably coupled to the wheel so that rotation of the wheel about the first rotational axis causes the plurality of bubble generating devices to repetitively move: (1) into contact with the bubble solution in the reservoir to load the bubble generating devices with the bubble solution; and (2) into simultaneous alignment with the air stream generated by the fan device and the opening in the hub assembly to generate bubbles from the bubble solution loaded on the bubble generating devices and allow the bubbles to flow into the ambient environment.

* * * * *